United States Patent [19]

Pachano et al.

[11] Patent Number: 4,752,376

[45] **Date of Patent: * Jun. 21, 1988**

[54] MULTIPLE STEPPED PROCESS FOR THE DEMETALLIZATION AND DESULFURATION OF HEAVY OIL FEEDSTOCKS

[75] Inventors: Jacinto Pachano, Caracas; Jose Guitian; Otto Rodriguez, both of Miranda; Julio H. Krasuk, Caracas, all of Venezuela

[73] Assignee: Intevep, S.A., Caracas, Venezuela

[ * ] Notice: The portion of the term of this patent subsequent to May 27, 2003 has been disclaimed.

[21] Appl. No.: 882,451

[22] Filed: Jul. 8, 1986

Related U.S. Application Data

[63] Continuation of Ser. No. 780,231, Sep. 25, 1985, abandoned.

[51] Int. Cl.[4] ..... C01G 67/04

[52] U.S. Cl. ..... 208/86; 208/210; 208/211; 208/216 PP; 208/251 H

[58] Field of Search ..... 208/86, 89, 210, 211, 208/216 PP, 251 H

[56] References Cited

U.S. PATENT DOCUMENTS

| | | | |
|---|---|---|---|
| 3,451,923 | 6/1969 | Welty, Jr. et al. | 208/211 |
| 3,755,196 | 8/1973 | Mickelson | 502/211 |
| 4,165,274 | 8/1979 | Kwant | 208/93 |
| 4,166,026 | 8/1979 | Fukui et al. | 208/210 |
| 4,212,729 | 7/1980 | Hensley, Jr. et al. | 208/210 |
| 4,591,426 | 5/1986 | Krasuk et al. | 208/96 |

*Primary Examiner*—Olik Chaudhuri
*Attorney, Agent, or Firm*—Bachman & LaPointe

[57] ABSTRACT

A process for treating heavy crude oil feedstocks to reduce the asphaltenes, metals and sulfur content thereof while maintaining a high conversion thereof comprising: subjecting the feedstock to an asphaltene separation stage and thereafter subjecting the deasphaltene crude to a first hydrotreatment stage employing a first macroporous catalyst so as to produce an intermediate partially demetallized and desulfurized product and thereafter treating said intermediate product in a second hydrotreatment stage using a microporous catalyst wherein the microporous catalyst exhibits extended life period.

1 Claim, No Drawings

MULTIPLE STEPPED PROCESS FOR THE DEMETALLIZATION AND DESULFURATION OF HEAVY OIL FEEDSTOCKS

This is a continuation of application Ser. No. 780,231, filed Sept. 25, 1985, now abandoned.

The present invention relates to the processing of heavy crude oil feedstocks. More particularly, it concerns a method for treating such heavy crudes in order to reduce the contaminant content of same.

One of the most difficult problems to solve up to now has been that of the processing of heavy crudes using catalysts. As is known, heavy crudes have a high level of asphaltenes, which means that hydrotreating them with catalysts is not suitable since those fractions of high molecular weight remain virtually intact in terms of the sulfur and vanadium contained in them. Additionally, the presence of asphaltenes in said heavy crudes means that coke readily forms on the catalysts, obstructing the pores thereof and thus quickly reduces its effectiveness.

Furthermore, the high molecular weight of the molecules of which said asphaltenes are formed facilitates their easy adsorption on polar surfaces, like the standard catalystic surfaces (alumina, silica/alumina, etc.), which produces premature inactivation of the active principles of the catalyst, also obstructing the openings of the pores. Likewise, during the heating of the crude loads in the process, said asphaltenes are more easily cracked than the resins and oils, being deposited on the catalytic beds. Additionally, since the asphaltenes contain most of the metal contaminants in the crude, such as vanadium, nickel, iron, etc., once these are deposited on the catalytic surface of the catalysts they also inactivate the active phase thereof, which aside from reducing their intrinsic catalytic activity, generates major diffusional resistances within the pores of the catalyst.

The resulting short active life of the hydrotreating catalysts is in large measure due to the fact that a large catalytic area is required in these catalysts, for which reason they are provided with relatively small-diameter pores, thus achieving high activity, for both desulfuring and demetallizing. On the other hand, as is also known, it is possible to achieve an extended useful life for a catalyst if it is formed with fairly large-diameter pores so that metals can be retained in them without obstructions but then such catalysts generally have a relatively low activity.

Forced to choose up to now between a long useful life with low activity on the one hand and a short useful life and high activity on the other, it has generally been necessary to seek a compromise situation between the two conditions; unfortunately, this has, in turn, only led to a less than desirable or optimum activity and a useful life which has been prolonged only relatively slightly. In short, the yield of the methods for processing heavy crudes at present is barely moderately acceptable, and, in addition, it is always necessary to choose between desulfuration and demetallization as the principle activity of said processing, since when a catalyst is acceptably active for one of these activities, it is generally less than moderately acceptable for the other, and vice versa, also depending on the size of the pores.

Attempts have hitherto been made to reach high levels for both desulfuration and demetallization with a single catalyst type, without, however, any appreciable commercial success, since the catalyst consumption has remained extremely high, unduly increasing production costs. This is also true with respect to the presence in the crudes being treated for the asphaltene content originally present in them, insofar as the asphaltenic portion of the crude is difficult to process by hydrotreatment catalysts.

The present invention has for its principle object overcoming said disadvantages prevalent in past catalyst systems.

Therefore, the present invention bases its principle on a method which basically includes three stages, represented in blocks in accompanying FIG. 1: A first stage 1 in which the original heavy crude is subjected to a deasphalting operation in which the asphaltenes present are extracted, using a heavy paraffinic solvent with which an initial and substantial demetallization is also achieved, and which appreciably facilitates the subsequent stages; a second stage 2 in which the deasphalted crude thus obtained is then subjected to a hydrotreatment in the presence of a first type of catalyst, appropriate in that it has high selectivity towards demetallization; and finally, a third stage in which the deasphalted and partially demetallized crude is subjected to a hydrotreatment 3 in the presence of a second type of catalyst, appropriate in that it has high selectivity towards desulfuration.

Figure 1
Process Diagram

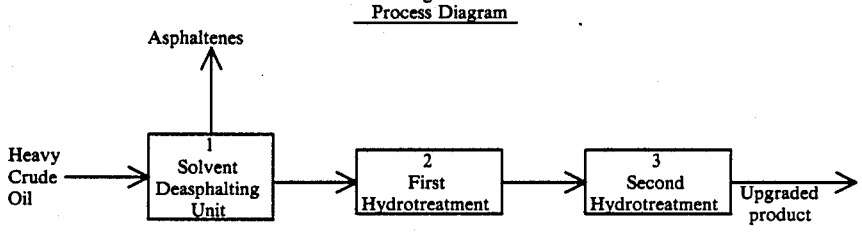

Because of the low level of asphaltenes remaining in the deasphalted oil and the special pore size distribution, which includes an important fraction of large pores, and high catalyst pore volume, the coke formed during the hydroprocessing does not plug the pore mouths of the catalyst in the second stage. In addition, when the intermediate product reaches the third and final stage, in which a catalyst is used with a relatively small pore diameter, said pores are obstructed neither by the asphaltenes (now virtually absent) nor by an excessive amount of metals present, since the metals have to a large extent been eliminated in the previous step. Hence, this arrangement of catalysts of different characteristics and employed after a severe deasphalting stage now leads to an economically attractive process providing a long useful life for the respective catalysts.

It has also been discovered that this excellent behavior of the method of the invention is further enhanced when, in the method's second stage (the first hydrotreatment), a catalyst with a macroporous base is used, thus making it possible to extend the useful life of said catalyst by permitting an increase in pore diameter used in this first hydrotreatment stage without reducing its activity. Preferably, this catalyst has the characteristics that will be described hereinbelow.

In accordance with the above-mentioned aspects, it is now possible to use the method of the present invention with virtually any type of hydrocarbon material, which may vary from a natural heavy crude to atmospheric residues, or vacuum residues, etc., all having a heavy asphaltene, sulfur, and/or metal content.

According to the concept of the present invention, the initial stage of the method is a deasphalting stage. In this stage, a crude feedstock of the aforementioned type is mixed with a heavy paraffinic solvent, which may be a mixture of components of 5 and 6 carbon atoms up to naphtha and which, in the preferred mode, is n-hexane, and with which a high yield of deasphalted oil is obtained. Said mixing is done at atmospheric pressure and temperature, followed by a step of separating out the asphaltenes produced, also at atmospheric pressure and temperature. Then, the product passes through a step in which the hexane is eliminated, for example, by applying a vacuum and/or heating the mixture to reduce viscosity and facilitate elimination. In this way, a deasphalted crude is obtained which has a hexane content of at most about two percent by volume.

The ratio of solvent to crude used is approximately 9/1 (volume/volume); and to the extent that this ratio is approximated, if Jobo crude of 12 API gravity is fed to stage 1 (FIG. 1), a yield will be obtained of 88% by weight and 89.2% by volume of deasphalted crude, although these values are not limiting, since they depend somewhat on the characteristics of the crude being processed.

It should also be noted here that as the highest concentration of metals, nitrogen and sulfur remains in the asphaltenes, when the deasphalted crude, following the foregoing stage, is of approximately 14 API gravity, about 46% demetallization is achieved.

The thus-obtained deasphalted crude is next fed to a first hydrotreatment stage intended to carry out the demetallization as its primary operation, and with a parallel first desulfuration as a collateral operation, conducted in the presence of a first type of catalyst.

As there is still a fairly considerable amount of metals in the deasphalted oil thus obtained, for this first hydrotreatment stage it is necessary to utilize a catalyst with a fairly large pore diameter, so that it can easily adsorb most of the metals remaining in the deasphalted oil but without appreciable detriment to its catalytic activity or its useful life.

According to the present invention, said first type of catalyst consists of a macroporous support, for example, silica or alumina, into which has been impregnated a first hydrogenation component selected from the group formed by at least one metallic component from Group VIB of the Periodic Table of elements, by at least one second metallic component from Group VIII of the Periodic Table of elements, and with the addition of small amounts of phosphorous. The average diameter of the catalyst's pores will here be between about 200 and 400 Å, with a surface area varying between about 50 and 200 $m^2/g$, a total pore volume varying between about 0.7 and 1.1 $cm^3/g$, and a proportion of phosphorous to carrier (measured as $P_2O_5$) of about 2 to 7 percent (weight/weight). There is also present approximately 6 to 19 percent of the metal from Group VIB (as its oxide) and 1 to 8 percent of the metal from Group VIII (as its oxide), based on the total weight (dry base) of the composition.

Preferably, as metal from Group VIB of the Periodic Table either molybdenum or tungsten is used, preferably in the form of its oxide or sulfide. Also preferably, as metal from Group VIII of the Periodic Table nickel or cobalt is used, preferably in the form of its oxide or sulfide; and the phosphorous will preferably be present as its oxide, more particularly as its pentoxide. The preferred catalyst is one impregnated with cobalt or molybdenum having a pore volume of about 0.78 $cm^3/g$ and a pore diameter of about 297 Å.

These characteristics mean that the molecules having a high molecular weight, where the metals are found, penetrate into the pore, without the pores becoming prematurely obstructed, depositing appreciable quantities of the metals contained in the product being treated, and without appreciable losses in activity over relatively extended periods, in addition to facilitating the subsequent hydrotreatment stage. Measured as output, this catalyst is likely to allow the treatment of large amounts of product, in between 10 and 20 barrels of deasphalted crude per pound of catalyst, with an effectiveness such that it permits reduction of the metals originally present in the deasphalted crude by 55 percent, along with hydrodesulfuration of around 45 percent.

It should also be pointed out here that these relatively low activities are due to the fact that the surface areas of this catalyst is relatively low (approximately 110 $m^2/g$) caused by the large pore diameter. However, if the pore diameter were reduced, this would limit the useful life of the catalyst, which makes it necessary to establish this compromise between activity and useful life.

The intermediate product from this (primarily) hydrodemetallization stage is then fed to a stage with hydrodesulfuration as primary operation and with hydrodemetallization as collateral operation, carried out in the presence of a second type of catalyst, preferably in a descending-flow fixed-bed reactor. The conditions of treatment for this second stage of hydrotreatment may generally be similar to those of the first stage of hydrotreatment, except with respect to the catalyst employed.

The catalyst employed in this second hydrotreatment stage may be any catalyst of Co/Mo on alumina, with a small pore diameter, for example, a catalyst with a surface area between 150 and 300 $m^2/g$ and a pore volume of around 0.5 ml/g, impregnated with approximately 10 to 20 weight percent molybdenum and 2.3 weight percent cobalt (obtainable commercially).

The product obtained in this second hydrotreatment stage is noticeably improved in comparison with the first, achieving a product with a 25° API and with a hydrodesulfuration level of 82 percent and a hydrodemetallization level of 84 percent, and with a liquid yield with respect to the original whole crude of 89.3 percent (volume/volume).

In FIG. 2, below, it is possible to note the progressive improvement of the crude through the stages of the process. It can easily be appreciated that to the extent the crude is hydrogenated, the ease with which impurities are eliminated is increased. It can also be seen from FIG. 2 that the asphaltenes remaining in the crude in the two hydrotreatment stages are eliminated to a level of only 50%, which indicates the difficulty of hydrotreating the said fraction and demonstrates the appropriateness of including the first stage of the process, i.e., the severe deasphalting stage.

In general, the conditions which may be used in the two hydrotreatment stages would employ a hydrogen/-crude ratio of between about 800 and 2000 $m^3N/m^3$; temperature of between about 350° and 430° C.; pressure of between about 1000 and 2500 psig, and space velocity of between about 0.5 and 1.5 $h^{-1}$. The use of a descending catalyst bed is an optimum mode of operation, but the invention is not limited to the use of a particular catalyst bed form.

The advantages of this method of the invention will be further understood from the illustration with the following non-limiting Examples.

EXAMPLE 1

A JOBO crude of 12.2° API having the following characteristics:

Sulfur content: 2.7–3% weight
Vanadium content: 334 ppm
Nitrogen content: 5400 ppm
Viscosity (140° F.): 630 centistokes
Asphaltenes: 8.21% weight
Conradson carbon: 10.29% weight was mixed with n-hexane at a ratio of 9 parts by volume of hexane per part by volume of crude at atmospheric pressure and temperature, and with strong agitation. The mixture was agitated for one and one-half hours after which the asphaltenes produced were separated out in a settling tank. By applying a vacuum and heating the mixture to a temperature of around 150° C., in order to reduce the product's viscosity, separation of the hexane was continued until its content was less than 2 percent by volume.

The deasphalted product was then fed to a fixed-bed, descending flow isothermal reactor of the Trickle-Bed type, with feeding from the upper end. The deasphalted crude was there mixed with hydrogen at around 5615 cubic feet of hydrogen per barrel of crude. The reactor was kept at a temperature of around 400° C. and a pressure of 1500 psig, with a LHSV of 1 $h^{-1}$. This stage is carried out on a catalytic bed consisting of a silica-base catalyst impregnated with Co and Mo, the physical characteristics of which are given in Table I, under the Catalyst I column. The hydrogen consumption in this stage of the process was about 450 cubic feet per barrel.

The resulting intermediate product was then fed into a second fixed-bed, descending flow reactor containing a different, micro-porous, alumina-based catalyst, the characteristics of which are given in Table I under the Catalyst II column, said reactor being operated under essentially the same conditions as the first. The hydrogen consumption in this second hydrotreatment stage was 600 cubic feet per barrel, which gives an overall hydrogen consumption for both stages of 1050 cubic feet per barrel.

The effectiveness of the method of the present invention through its various stages can be deduced from the aforementioned FIG. 2.

Comparing in Table II the characteristics of the final product with what a synthetic crude should give, as shown in Table III, it will be seen that the product obtained in this Example has all the properties required. Most important of what is observed is that 96 percent of the crude distills under 995° F., thereby indicating major conversion to light products.

It can also be seen that after the second hydrotreatment stage (with the microporous, alumina-based catalyst) the quality of the product has considerably improved, with hydrogenation of light and heavy cuts being observed. The diesel cut increased its cetane number to 44; but the most notable result is that 96 percent of the crude distills under 995° F., its sulfur content being less than 0.36 percent. Another major result is that more than 50 percent of the product (fraction 600° F.–995° F. = 55% V) can be fed to F.C.C., indicating by its aniline point (177.5° F.) a major conversion to gasoline; and while the level of nitrogen, which is the most difficult element to remove, has a relatively high value, it shows no difficulty in being fed to catalytic cracking (F.C.C.).

TABLE I

PROPERTIES OF THE CATALYSTS

| | Catalyst I | Catalyst II |
|---|---|---|
| Chemical Properties | | |
| CoO % weight | 2.5 | 2.3 |
| $MoO_3$ % weight | 12.5 | 10.2 |
| $Al_2O_3$ % weight | — | Balance |
| $P_2O_5$ % weight | 6.0 | — |
| $SiO_2$ % weight | Balance | — |
| Physical Properties | | |
| Form | Extrudate | Extrudate |
| Particle diameter mm | 3.0 | 0.8 |
| Particle length mm | 3.0 | 4.0 |
| Surface area (Sg) $m^2/g$ | 110–97 | 219 |
| Pore volume (PV) ml/g | 0.81 | 0.64 |
| Cumulative volume ml/g | 0.763 | 0.340 |
| **Average pore diameter (pd) Å | 297 | 117 |
| Bed density g/ml | 0.56 | 0.64 |
| Apparent density (ad) g/ml | 0.82 | 1.1 |
| Real density (d) g/ml | 2.37 | 3.67 |
| Bed resistance $kgf/cm^2$ | — | — |
| Pellet resistance kgf/pellet | 4.95 | — |
| Pore distribution ml/g | | |
| Diameter Å | % | % |
| 0–90 | 7.85 | 31.10 |
| 90–300 | 72.67 | 46.5 |
| >300 | 19.48 | 22.40 |

TABLE II

CHARACTERIZATION OF THE FINAL PRODUCT

| | Distillation | | | | |
|---|---|---|---|---|---|
| Analysis | Fraction $C_5$ - 600° F. | Fraction 400° F.–600° F. | Fraction 600° F.+ | Fraction 600° F.–995° F. | Fraction 995° F.+ |
| Yield (% V) | 41 | | 59 | 55 | 4 |
| Yield (% weight) | 38.8 | | 61.2 | 56.8 | 4.4 |
| API gravity 60° F. | 33.9 | 31.3 | 17.7 | 19 | 1 |
| Spec. Grav. 60° F./60° F. | 0.8555 | 0.8692 | 0.9484 | 0.9402 | 1.068 |
| Sulfur (% weight) | 0.1 | | 0.36 | | |
| Vanadium (ppm) | | | 16 | | |
| Nitrogen (ppm) | 233 | | 3029 | 2216 | |
| Conradson carbon (% weight) | | | 4.33 | | |
| Asphaltenes (% weight) | | | 1.69 | | |

TABLE II-continued

| CHARACTERIZATION OF THE FINAL PRODUCT | | | | | |
|---|---|---|---|---|---|
| | Distillation | | | | |
| Analysis | Fraction $C_5$ - 600° F. | Fraction 400° F.-600° F. | Fraction 600° F.+ | Fraction 600° F.-995° F. | Fraction 995° F.+ |
| Cetane number | | 44 | | | |
| Aniline point (°F.) | | | | 177.5 | |

FIGURE 2
PROCESSING DIAGRAM

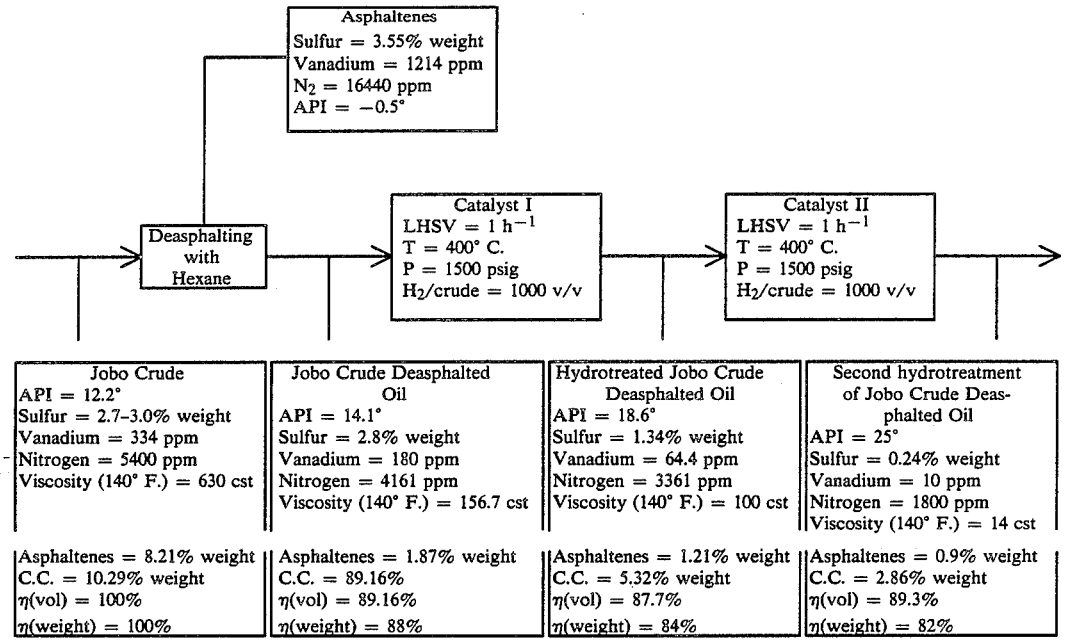

TABLE III

| YIELDS AND CHARACTERISTICS OF THE VARIOUS FRACTIONS FOR A SYNTHETIC CRUDE | | |
|---|---|---|
| Fraction | Yield (% vol) | |
| $C_4$-375° F. | 10-25 | |
| 375-650° F. | 25 (min.) | |
| 650-1000° F. | 40-50 | |
| 1000° F. | 25 (max.) | |
| | Characteristics of the fraction | |
| | Min. | Max. |
| $C_4$-375° F. | | |
| S (% WT) | — | 0.05 |
| $N_2$ (ppm) | — | 2 |
| 375-650° F. | | |
| S (% WT) | — | 0.2 |
| Cetane (#) | 35 | 45 |
| 650-1000° F. | | |
| S (% WT) | — | 0.5 |
| $N_2$ (ppm) | — | 1000 |
| C.C.R. (% WT) | — | 0.7 |
| Metals (ppm) | — | 2 |
| 1000° F.+ | | |
| S (% WT) | — | 1.25 |
| Metals (ppm) | — | 150 |

EXAMPLE 2

A Morichal crude of 12° API with the following characteristics:

Sulfur content: 2.5-3.0% weight
Vanadium content: 347 ppm
Nitrogen content: 5650 ppm
Viscosity (140° F.): 670 centistokes
Asphaltenes: 8.91 % weight
Conradson carbon: 11.23% weight The crude is passed through a first deasphalting stage, according to the procedure described in the previous example.

The deasphalted product is then fed to a downflow and fixed-bed isothermal reactor of the Trickle-Bed type. There, the deasphalted crude is mixed with hydrogen, at the rate of around 5600 cubic feet of hydrogen per barrel of crude. The reactor is maintained at a temperature of about 390° C. and a pressure of 1500 psig, with an LHSV of 1 $h^{-1}$. This stage is carried out in a catalytic bed formed by an alumina base catalyst impregnated with Co and Mo, whose physical characteristics are given in Table IV, under the column Catalyst I.

Afterwards the product was fed to a second downflow fixed-bed reactor, which contained an alumina base catalyst, whose characteristics are given in Table IV, under the column Catalyst II. The reactor was operated at a temperature of 410° C. and a pressure of 1500 psig, with an LHSV of 0.5 $h^{-1}$. The total hydrogen consumption for the two hydrotreating stages was 1295 cubic feet per barrel.

TABLE IV

| CATALYST PROPERTIES | | |
|---|---|---|
| | Catalyst I | Catalyst II |
| Chemical Properties | | |

TABLE IV-continued

| CATALYST PROPERTIES | Catalyst I | Catalyst II |
|---|---|---|
| NiO | — | 1.73 |
| CoO | 4.53 | — |
| $MoO_3$ | 12.85 | 8.1 |
| $Al_2O_3$ | Balance | Balance |
| Physical Properties | | |
| Shape | Extrudate | Extrudate |
| Particle diameter, mm | 0.8 | 0.8 |
| Particle length, mm | 4.0 | 4.0 |
| Surface area, $m^2/g$ | 184 | 177 |
| Pore volume, ml/g | 1 | — |
| Cumulative volume, ml/g | 1.0 | 0.67 |
| Average pore diameter, Å | 217 | 151 |
| Bed density, g/ml | 0.47 | 0.55 |
| Apparent density, g/ml | 0.77 | — |
| Real density, g/ml | 3.36 | 4.1 |
| Bulk crushing strength, $Kgf/cm^2$ | 5.80 | — |
| Side crushing strength, Kgf/pellet | — | — |
| Pore size distribution | | |
| Diameter Å | % | % |
| 0–90 | 39.07 | 39.68 |
| 90–300 | 48.64 | 48.60 |
| >300 | 12.29 | 11.72 |

FIG. 3 shows the results obtained in each stage. Table V presents the properties of the final product obtained in this example. It can be seen that the yield of medium distillates is high, while that of the vacuum residue is relatively low. The 375°–650° F. cut, with a high cetane index, shows characteristics of a good diesel fuel. The 650°–1050° F. cut has properties similar to those of catalytic cracking feeds.

The properties of the 1050° F.+ residue are suitable for feeding to a coking unit in order to obtain an optimum quality coke.

The general characteristics of the product indicate that they are within the specifications for a synthetic crude.

From the foregoing, it will be seen that a method is provided for the processing of heavy crudes which, aside from its final optimum results, considerably reduces operating and investment costs, provides a high liquid yield, has great operability because of the low pressure at which it works, and requires low catalyst consumption.

FIGURE 3
PROCESSING SCHEME (EXAMPLE 2)

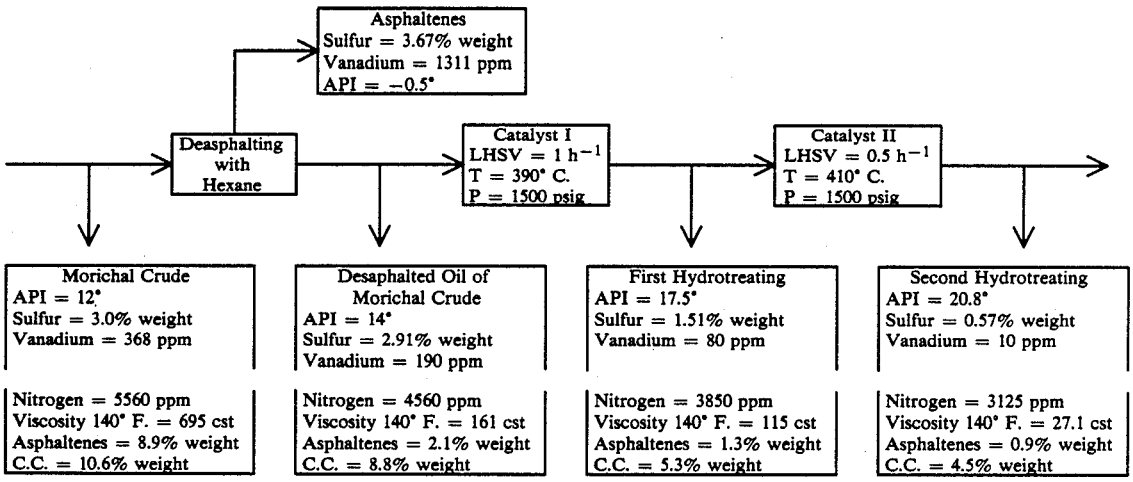

TABLE V

| CHARACTERIZATION OF THE FINAL PRODUCT<br>Analysis | Fraction $C_5$+ - 375° F. | Fraction 375–650° F. | Fraction 650–1050° F. | Fraction 1050° F.+ |
|---|---|---|---|---|
| Yield (% V) | 4.6 | 32.8 | 40.1 | 22.5 |
| Yield (% weight) | 4.07 | 30.81 | 40.25 | 24.87 |
| API gravity, 60° F. | 40.2 | 30.8 | 20.0 | 6.0 |
| Spec. gravity, 60/60° F. | 0.824 | 0.872 | 0.912 | 1.029 |
| Sulfur, (% weight) | | — | 0.42 | 1.9 |
| Vanadium, (ppm) | | — | 2 | 41 |
| Nitrogen, (ppm) | | 295 | 2115 | 5600 |
| Asphaltenes, (% weight) | | | | 4.0 |
| Viscosity at 140° F. (cst) | | | 41.7 | |
| Conradson carbon, (% weight) | | | 0.5 | 17.0 |
| Cetane index | | 44 | | |
| Aniline point | | | 173 | |
| Bromine number | 2 | | | |

What is claimed is:

1. A process for the processing of heavy crude oil feedstock to reduce or eliminate the asphaltenes, metals and sulfur content thereof, which process consists essentially of employing the following successive stages:

(a) subjecting crude feedstock to a deasphalting stage wherein, (i) said crude feedstock is mixed with a heavy paraffinic solvent at atmospheric pressure and temperature and (ii) the asphaltenes produced in stage (a) (i) are separated out leaving a solvenated deasphalted crude product;

(b) purifying the product from stage (a) (ii) to substantially eliminate the solvent by means of one of the following:

(i) vacuum and heat, (ii) vacuum, or (iii) heat to thereby obtain a deasphalted and substantially desolvenated crude;

(c) subjecting the deasphalted crude from step (b) to a first hydrotreatment stage using a macroporous first catalyst having an average pore diameter between 200 A and 400 A composed of a silica or alumina carrier a surface area of between about 50 and 200 $m^2/g$, and a total pore volume varying between about 0.7 and 1.1 $cm^3/g$, and which has been impregnated with (i) between about 1 to about 8 weight percent cobalt or nickel, (ii) between about 1 to about 8 weight percent cobalt and between about 6 to about 19 weight percent molybdenum, (iii) between about 1 to about 8 weight percent nickel and between about 6 to 19 weight percent molybdenum or (iv) between about 6 and 19 weight percent molybdenum; and (d) subjecting said hydrotreated oil from step (c) to a second hydrotreatment stage using a microporous second catalyst having an average pore diameter between 80 A and 200 A, a surface area of between about 250 and 300 $m^2/g$, and a total pore volume varying between about 0.4 and 0.5 $cm^3/g$, and which has been impregnated with about 2.3 weight percent of cobalt or nickel, about 2.3 weight percent of cobalt or nickel and about 10 to 20 weight percent molybdenum, or between about 10 and 20 weight percent molybdenum and wherein each of said hydrotreatment stages (c) and (d) are carried out under the following conditions: (a) a hydrogen/crude feedstock ratio of between about 80 and 2000 $m^3N/m^3$; (b) temperature of between about 350° C. and 430° C.; (c) a pressure of between about 1000 psig and 2500 psig, and (d) a space velocity of between about 0.5 and 1.5 $h^{-1}$.

* * * * *